US005682620A

United States Patent [19]

Stoltz et al.

[11] Patent Number: 5,682,620

[45] Date of Patent: Nov. 4, 1997

[54] DRAIN CABLE APPARATUS

[75] Inventors: David L. Stoltz; Max E. Murphy, both of Manhattan, Kans.

[73] Assignee: Stoltz & Murphy Inc., Manhattan, Kans.

[21] Appl. No.: 560,294

[22] Filed: Nov. 17, 1995

[51] Int. Cl.[6] ..... E03D 9/00

[52] U.S. Cl. ..... 4/255.04; 4/255.01; 15/104.33; 15/256.6

[58] Field of Search ..... 4/255.01, 255.04, 4/255.06, 255.08; 15/104.33, 256.6

[56] References Cited

U.S. PATENT DOCUMENTS

| | | | |
|---|---|---|---|
| 1,748,900 | 2/1930 | Pilla | 15/256.6 |
| 2,222,191 | 11/1940 | Zisman | 15/220.4 |
| 2,241,560 | 5/1941 | Schouler | 15/104.33 |
| 2,285,742 | 6/1942 | Miller | 15/220.4 |
| 2,499,801 | 3/1950 | Tubbs | 15/104.33 |
| 3,872,521 | 3/1975 | Friedman | 15/104.33 X |
| 3,897,601 | 8/1975 | Wusterfeld | 15/104.33 X |
| 3,999,240 | 12/1976 | Uchida | 15/256.6 |
| 4,422,208 | 12/1983 | Rohrbaugh | 15/256.6 |
| 4,543,683 | 10/1985 | Goldman | 15/256.6 |
| 4,570,285 | 2/1986 | Skelton | 15/256.6 |
| 5,022,493 | 6/1991 | Buckelew | 184/16 |
| 5,077,861 | 1/1992 | Bokat | 15/256.5 |
| 5,107,550 | 4/1992 | Hawro | 4/255.08 |
| 5,301,382 | 4/1994 | Stout | 15/104.33 |
| 5,509,148 | 4/1996 | Steele et al. | 4/255.01 |

*Primary Examiner*—Robert M. Fetsuga

*Attorney, Agent, or Firm*—Hovey, Williams Timmons & Collins

[57] ABSTRACT

An improved drain cable apparatus (10) is provided which facilitates clearing of clogged drainpipes (16) while providing a way to readily determine whether the drainpipe (16) has been cleared, without the necessity of withdrawing the drain cable (70) from the drainpipe (16). The apparatus (10) includes a tubular main body (12) adapted for connection via a sleeve (34) to the drainpipe (16); the main body (12) is equipped with internal drain cable-cleaning sponge elements (32), as well as an apertured end cap member (18) permitting insertion of the drain cable (70). Structure (20) for determining when the drainpipe (16) has been cleared includes a water inlet (48) and a spaced water outlet (54) arranged so that water delivered to the main body (12) passes outwardly through the outlet (54) while the drainpipe (16) remains clogged, but allows such water to pass through the drainpipe (16) when the latter is clear. In this fashion the user can readily determine when the drainpipe (16) is unclogged by visually observing water flow from the outlet.

9 Claims, 1 Drawing Sheet

DRAIN CABLE APPARATUS

BACKGROUND OF THE INVENTION

1. Field of the Invention

The present invention is broadly concerned with an improved apparatus for use by plumbers and others to facilitate unclogging of pipes, typically a household drainpipe. More particularly, the invention pertains to such apparatus which includes an elongated tubular main body adapted for coupling to the open end of a clogged pipe, and permitting passage therethrough of an elongated, powered, axially rotatable drain cable; the tubular main body is advantageously equipped with a water inlet and a spaced water outlet permitting the user to readily ascertain whether the pipe has been properly cleared. In preferred forms, the tubular main body is formed from a pair of hingedly interconnected segments each having cleaning material embedded therein. The cleaning material is provided for removing waste or other deleterious substances from the drain cable as it is removed from the tubular main body.

2. Description of the Prior Art

Clogged drains are a common and troublesome problem for many homeowners and businesses. The first response to a clogged drain is normally the use of harsh chemical drain cleaners which are poured into the drain in an attempt to clear the blockage. Often, repeated attempts using such chemicals are tried. If this is unsuccessful, the homeowner or business owner may then resort to water pressure-actuated devices attached to an adjacent faucet. In many cases, these expedients are successful; however, if the blockage is truly intractable, the only resort for most people is to call a professional plumber.

Most often, plumbers make use of an elongated, metallic, powered drain cables or "snakes" for drain cleaning. These conventional devices are fed into the open drainpipe and rotated by means of a remote electrical or mechanical motor. The rotating action of the drain cable is almost always successful in rapidly clearing the drain. A problem in the use of drain cables is that, upon withdrawal thereof from the drainpipe, waste material including vestiges of the previously used harsh chemicals can be sprayed onto adjacent cabinets or onto the plumbers themselves. This necessitates that the plumbers exercise extreme care when using drain cables, else they be contacted with the harsh and/or unhealthful materials from the cleared drainpipe. Another problem encountered in use of conventional drain cables is the difficulty of determining when the clog has been effectively cleared. One common approach is to pour water down the drainpipe, but this may require complete removal of the cable at successive intervals, and is thus time consuming.

In response to these problems, it has been suggested in the past to clean a cable with wiping or cleaning elements attached to devices positioned near a drain. For example, U.S. Pat. No. 2,222,191 describes a line cleaning device employing wiping elements which are designed to engage a cleaning cable or the like as it is being pulled from a well. U.S. Pat. No. 5,077,861 describes a hose cleaning device made up of a tubular hose-receiving body having internal brush elements. The '861 patent also discloses the use of a water inlet fitting allowing water to be introduced into the device to assist in hose cleaning. While these devices can be effective for cleaning of the drain cables, they provide no way of readily determining whether a given clog has been removed.

SUMMARY OF THE INVENTION

The present invention overcomes the problems covered above and provides an improved apparatus adapted for coupling to a clogged pipe, typically a household drainpipe, in order to assist in clearing the pipe blockage with a conventional powered drain cable. Broadly speaking, the apparatus of the invention includes an elongated tubular main body having means adjacent one end thereof for connecting the main body to an open end of a pipe, together with structure adjacent the opposite end of the main body for receiving an elongated drain cable and allowing passage thereof into the pipe.

The apparatus further has means for determining when the pipe has been unclogged by the action of the drain cable, allowing the user to readily ascertain this successful result without the necessity of repeatedly removing the drain cable from the pipe. To this end, the main body is equipped with a spaced water inlet and water outlet extending therethrough intermediate the ends of the body, wherein the inlet and outlet are positioned for allowing external water to be delivered into the main body interior through the inlet and to flow through the pipe when the latter has been cleared. While the pipe remains clogged, however, the external water flows through the main body outlet and can thus be clearly observed. In preferred forms, the water outlet is positioned approximately 45 degrees below the vertical axis of the main body for allowing water to flow through the pipe when the pipe has been cleared and for discharging water out of the main body when the pipe remains clogged.

In more detail, the preferred apparatus of the invention makes use of a tubular main body formed of a pair of hingedly interconnected, generally semi-circular in cross-section segments, with each of the segments having resilient sponge elements therein for wiping of a drain cable upon withdrawal thereof. Use of such hinged segments allows the apparatus of the invention to be secured about a drain cable even after the leading end of the latter has been inserted into a pipe. Attachment of the tubular main body to the pipe is most readily effective by means of a resilient rubber-like sleeve and conventional circumferential clamps.

DESCRIPTION OF THE PREFERRED EMBODIMENTS

Figures 1, 2:
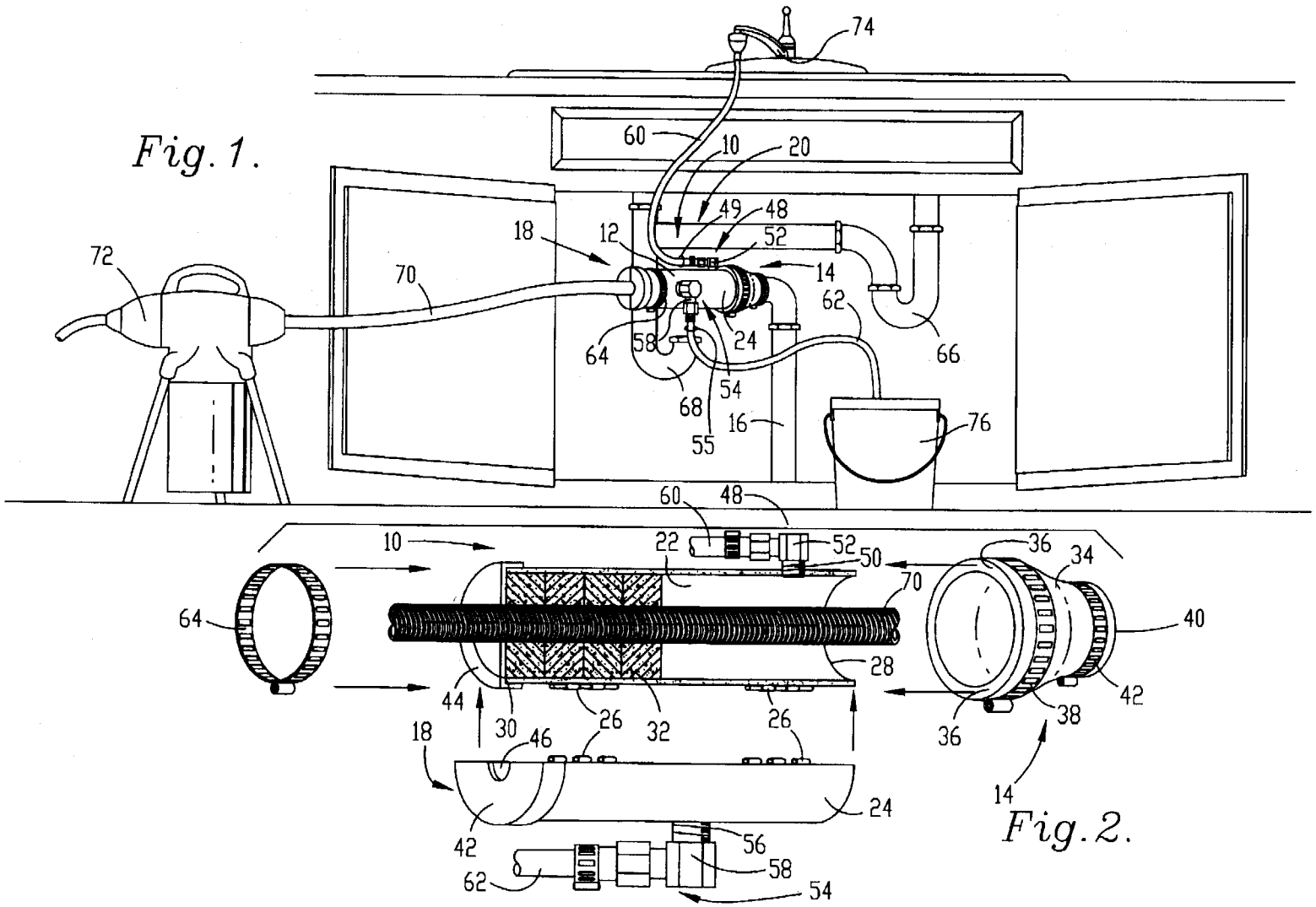
FIG. 1 is an elevational view illustrating the use of the drain cable apparatus of the invention mounted on a clogged drainpipe and receiving a powered drain cable.
FIG. 2 is a fragmentary, exploded view illustrating the components of the drain cable apparatus together with a section of a drain cable.

Turning now to the drawing, drain cable apparatus 10 broadly includes main body 12, means 14 for operably coupling one end of body 12 with drainpipe 16, opposed end cap member 18 affixed to the other end of body 12, and structure referred to by numeral 20 for determining when drainpipe 16 has been cleared.

In more detail, main body 12 is preferably tubular in shape and is formed by a pair of elongated, arcuate, semi-circular cross-section segments 22,24. The segments 22,24 are preferably connected by hinges 26 (see FIG. 2) but may also be interconnected or interlocked by other known means. As illustrated, segments 22,24 cooperatively define tubular main body 12 and thus present connecting end 28 adapted for connection to drainpipe 16, and opposed free end 30 remote from drainpipe 16. In addition, each of segments 22,24 carries a plurality of semi-annular sponge elements 32 which are positioned in an abutting relationship adjacent free end 30.

Sponge elements 32 are preferably removable from segments 22,24 so that they can be quickly replaced after a number of uses. Segments 22,24 may also include a plurality of brushes or similar wiping or cleaning devices instead of sponge elements 32.

Coupling means 14 is preferably in the form of resilient rubber-like sleeve 34 having enlarged end 36 adapted to fit over connecting end 28 of main body 12. First circumferential clamp 38 fits over enlarged end 36 as shown and serves to sealingly attach sleeve 34 to main body 12. Reduced diameter end 40 of sleeve 34 is similarity designed to fit over the open end of drainpipe 16, and second circumferential clamp 42 is employed for making this a water tight connection. Coupling means 14 alternatively may include 0-rings or other sealing devices.

Segments 22,24 also carry end cap sections 42,44 which cooperatively define, when segments 22,24 are closed together, end cap member 18 presenting cable-receiving opening 46 therethrough. In this way main body 12 can accommodate a drain cable and allow passage thereof into drainpipe 16.

The clearance-determining structure 20 includes water inlet 48 through one of segments 22,24 (an embodiment illustrated, inlet 48 is provided through segment 22). Inlet 48 is preferably in the form of threaded nipple 50 and elbow fitting 52. Similarly, structure 20 has water outlet 54 through opposed segment 24, and again outlet 54 has a threaded nipple 56 and elbow fitting 58. As best shown in FIG. 1, water inlet hose 60 is secured to elbow 52 and is adapted for connection to an external source of water. Outlet hose 62 is likewise attached to elbow 58 as shown.

Inlet 48 and outlet 54 may alternatively be integrally formed with main body 12 rather than formed separately and may include valves 49,55 for controlling the flow of liquids into and out of main body 12. Drain cable apparatus 10 may also include additional inlets and outlets for introducing and draining soaps, chemical neutralizers, sanitizers and other liquids or chemicals into and from main body 12. Alternatively, these liquids and chemicals may be introduced into inlet hose 60 by way of a Y-connector. With this latter construction, a back-flow preventor or valve must be inserted in inlet hose 60.

Although not essential, an additional degree of structural integrity may be provided by use of circumferential clamp 64 disposed about main body 12 when the latter is affixed to drainpipe 16 (see FIG. 1).

The use of apparatus 10 is best illustrated in FIG. 1, in the context of clearing of household drainpipe 16. As shown, the overall plumbing includes a pair of interconnected traps 66,68 with a transition (not shown) coupling traps 66,68 to upstanding drainpipe 16. In use, the plumber first removes the transition and attaches end 28 of main body 12 to drainpipe 16 using sleeve 34 and clamps 38,42. Main body 12 is oriented such that outlet 54 is disposed below inlet 48; the purpose of this arrangement will be made clear hereinafter.

At this point conventional elongated drain cable 70, powered by motor assembly 72, is passed through opening 46 and into the interior of body 12 where it ultimately passes into drainpipe 16. At this point hose 60 may be coupled to a convenient source of water such as faucet 74, and bucket 76 is placed below the outlet of hose 62. The operation of drain cable 70 is next commenced, causing the cable to rotate and remove the clog within drainpipe 16. At the same time, water flow is begun through main body 12 via hoses 60,62. As will be readily appreciated, as long as drainpipe 16 remains clogged, the water from inlet hose 60 passes out of main body 12 through outlet hose 62 for collection in bucket 76. However, once the clog has been removed, the incoming water flows out of end 28 of main body 12 and through drainpipe 16. Thus the plumber can readily determine when drainpipe 16 has been cleared by watching the outlet of hose 62; when water stops flowing from this outlet, the plumber can be assured that drainpipe 16 is clear.

In preferred forms, water outlet 54 is positioned approximately 45 degrees below the vertical axis of main body 12 for allowing water to flow through drainpipe 16 when drainpipe 16 has been cleared and for discharging water out of main body 12 when drainpipe 16 remains clogged.

After drainpipe 16 has been cleared, the plumber pulls drain cable 70 upwardly out of drainpipe 16 and through apparatus 10. At this time wiping sponges 32 come into play and serve to clear the end of drain cable 70 of waste and other materials, the latter being readily washed away by the continued flow of water from inlet hose 60 through inlet 48. Hence, drain cable 70 may be safely withdrawn from apparatus 10.

In view of the fact that main body 12 is of segmented construction, it may be secured in place over drain cable 70 after the latter has been inserted within drainpipe 16. Of course, in this mode of use clamp 64 must first be threaded onto drain cable 62 before the latter is inserted into drainpipe 16. Very specifically, segments 22,24 are simply closed about installed drain cable 70 and clamps 38,64 associated with main body 12 are tightened. The final connection involves tightening of clamp 42 to secure end 40 of sleeve 34 in place on drainpipe 16.

Although the invention has been designed with reference to the preferred embodiment illustrated in the attached drawing figures, it is noted that equivalents may be employed and substitutions made herein without departing from the scope of the claims. For example, although the invention has been described as being used for unclogging a household drain, it may be adopted for use with any pipe or drain including those found in commercial and industrial businesses.

We claim:

1. Apparatus adapted for coupling to a pipe, comprising:

a main body presenting an outer wall, a body interior, and opposed connecting and free ends;

means for operably coupling said connecting end to the pipe with the interiors of said main body and the pipe being in communication with each other;

means for defining a cable-receiving opening adjacent said free end for receiving a cable within said body interior for passage thereof into the pipe;

means for determining when the pipe has been unclogged, including an inlet and an outlet extending through said body outer wall intermediate said ends, said inlet and said outlet being positioned for allowing water delivered to said main body interior through said inlet to flow through the pipe when the pipe has been unclogged, and to flow through said outlet when the pipe remains clogged;

said main body comprising a pair of elongated, segmented, mating body sections which are mated together to sandwich the cable therebetween after the cable is inserted in the pipe; and a cleaning material located within said main body for removing waste material from the cable as the cable is retracted from said apparatus, said cleaning material comprising a pair of mating, segmented sponge sections each positioned in one of said body sections so that said sponge sections mate together and completely surround and encase a portion of the cable when the body sections are mated together over the cable.

2. The apparatus of claim 1, said coupling means comprising a sleeve including a tubular body presenting a tubular wall, a body interior, and a pair of opposed ends, one of said sleeve ends being attached to said apparatus connecting end and the other of said sleeve ends being adapted for attachment to the pipe, there being a pair of circumferential clamps operatively deposed on each of said sleeve ends for causing said sleeve to sealingly engage said apparatus connecting end and the pipe.

3. The apparatus of claim 1, wherein said body sections are each semi-annular in cross-section.

4. The apparatus of claim 1, said opening-defining means comprising an apertured cap covering said apparatus free end.

5. The apparatus of claim 1, said outlet being below said inlet when said apparatus is attached to the pipe.

6. The apparatus of claim 1, further comprising an inlet hose having one end attached to said inlet and an opposed end adapted for communication with a water tap.

7. The apparatus of claim 1, further comprising an outlet hose having one end attached to said outlet and having an opposed end adapted for water removal.

8. The apparatus of claim 1, the pipe being a household drainpipe.

9. The apparatus as set forth in claim 1, further including a valve positioned in each of said inlet and outlet for controlling the flow of liquids into and out of said main body for permitting the water pressure in the main body to be selectively increased and decreased for facilitating unclogging of the drain.

* * * * *